US008764236B2

(12) United States Patent
Caroom, Jr. et al.

(10) Patent No.: US 8,764,236 B2
(45) Date of Patent: Jul. 1, 2014

(54) VERSATILE LIGHTING UNITS

(75) Inventors: Jerry H. Caroom, Jr., Hot Springs, AR (US); Ken McAlpin, Hitchcock, TX (US); Luis E. Anker, League City, TX (US); Jason H. Lynch, Dickinson, TX (US)

(73) Assignee: XtraLight Manufacturing Partnership Ltd, Houston, TX (US)

( * ) Notice: Subject to any disclaimer, the term of this patent is extended or adjusted under 35 U.S.C. 154(b) by 26 days.

(21) Appl. No.: 13/557,582

(22) Filed: Jul. 25, 2012

(65) Prior Publication Data

US 2012/0294008 A1 Nov. 22, 2012

Related U.S. Application Data

(63) Continuation of application No. 13/205,425, filed on Aug. 8, 2011, now Pat. No. 8,322,906.

(51) Int. Cl.

| | |
|---|---|
| ***F21V 21/00*** | (2006.01) |
| ***F21S 2/00*** | (2006.01) |
| ***F21V 21/002*** | (2006.01) |
| ***F21V 23/00*** | (2006.01) |
| ***F21V 23/06*** | (2006.01) |

(52) U.S. Cl.

CPC ..... *F21S 2/005* (2013.01); *F21V 21/002* (2013.01); *F21V 23/005* (2013.01); *F21V 23/06* (2013.01)

USPC ..... 362/249.02; 362/249.03; 362/249.06; 362/647; 439/111; 439/112

(58) Field of Classification Search

CPC ..... F21S 2/005; F21S 8/026; F21V 21/002; F21V 23/005; F21V 23/06; H01R 25/14

USPC ..... 362/249.02, 249.03, 404, 648, 147, 362/249.06, 647; 439/111, 112

See application file for complete search history.

(56) References Cited

U.S. PATENT DOCUMENTS

| | | | |
|---|---|---|---|
| 2,938,068 | A | 5/1960 | Silverschotz |
| 3,346,755 | A | 10/1967 | Christiansen |
| 4,999,936 | A | 3/1991 | Calamia et al. |
| 5,568,361 | A | 10/1996 | Ward et al. |
| 5,856,029 | A | 1/1999 | Burrows |
| 6,188,028 | B1 | 2/2001 | Haba et al. |
| 6,422,716 | B2 | 7/2002 | Henrici et al. |
| 6,696,786 | B2 | 2/2004 | Burrows |
| 6,851,831 | B2 | 2/2005 | Karlicek, Jr. |
| 6,891,200 | B2 | 5/2005 | Nagai et al. |
| 7,572,031 | B2 | 8/2009 | Schultz et al. |
| 7,591,649 | B2 | 9/2009 | Yen et al. |
| 7,607,793 | B2 | 10/2009 | Coushaine et al. |
| 7,621,655 | B2 | 11/2009 | Roberts et al. |
| 7,710,045 | B2 | 5/2010 | Schultz et al. |
| 7,744,266 | B2 | 6/2010 | Higley et al. |

(Continued)

*Primary Examiner* — Stephen F Husar
(74) *Attorney, Agent, or Firm* — Fulbright & Jaworski LLP

(57) ABSTRACT

Systems and methods which provide a versatile lighting module which may be utilized alone or in combination with other lighting modules to provide any number of lighting unit configurations are shown. Lighting modules of embodiments herein are adapted to facilitate electrical connection, whether to one or more power supply and/or to one or more other lighting module, along any portion of the entire periphery of the lighting module. Accordingly, lighting modules may be coupled together in any orientation, geometry, and topology to cooperate as a light source having various desired characteristics according to embodiments herein.

23 Claims, 8 Drawing Sheets

(56) References Cited

U.S. PATENT DOCUMENTS

| | | | | |
|---|---|---|---|---|
| 7,806,560 | B2 | 10/2010 | Schultz et al. | |
| 7,824,073 | B2 | 11/2010 | Hsieh et al. | |
| 7,888,861 | B2 | 2/2011 | Custodis | |
| 7,897,980 | B2 | 3/2011 | Yuan et al. | |
| 7,944,708 | B2 | 5/2011 | Lin | |
| 7,946,727 | B2 | 5/2011 | Lee | |
| 8,322,906 | B2 * | 12/2012 | Caroom et al. | 362/249.02 |
| 2008/0037284 | A1 | 2/2008 | Rudisill | |
| 2010/0099276 | A1 | 4/2010 | Capeleto et al. | |

* cited by examiner

VERSATILE LIGHTING UNITS

CROSS-REFERENCE TO RELATED APPLICATIONS

The present application is a continuation of commonly assigned, patent application Ser. No. 13/205,425 entitled "VERSATILE LIGHTING UNITS," filed Aug. 8, 2011, and issued as U.S. Pat. No. 8,322,906 on Dec. 4, 2012, the disclosure of which is hereby incorporated herein by reference.

TECHNICAL FIELD

The present invention relates generally to lighting units and, more particularly, to lighting units which are versatile to allow their use in a plurality of configurations.

BACKGROUND OF THE INVENTION

In the lighting industry, it is desirable to produce a lighting system (e.g., general or special purpose illumination for aiding human viewing of objects and environments) that has low electrical consumption, produces high light (lumen) output, is long lasting, and is highly versatile. As such, there is a need to move away from traditional and present day lighting units (often referred to as "lamps" or even "bulbs"). For example, lighting units such as incandescent lighting units (e.g., standard metal filament and halogen lighting units) consume relatively large amounts of power as compared to the lumens produced. Although fluorescent lighting units (e.g., cold cathode and hot cathode fluorescent lighting units) have been developed, which provide higher efficacy (e.g. higher lumen output per watt) as compared to incandescent lighting units, such fluorescent lighting units generally include hazardous materials (e.g., mercury) and thus pose an environmental threat. Moreover, such fluorescent lighting units require a current limiter (referred to as a ballast), making them more costly to install initially than incandescent lighting units and limiting the configurations in which they may be used.

The aforementioned lighting units as available today, regardless of the particular light emission technology employed (e.g., incandescent, fluorescent, etc.) generally lack versatility. Each such lighting unit is provided in relatively few form factors with limited numbers of electrical connection configurations and orientations. For example, if a user purchases a typical incandescent lighting unit the form factor generally comprises a globe type convenient for use in a desk lamp or residential overhead lighting fixture, such an incandescent lighting unit is not well suited for situations where light distributed over an area is needed (e.g., backlit sign lighting). Likewise, such an incandescent lighting unit cannot be made to work adequately in many lighting fixture configurations (e.g., commercial ceiling panel lighting fixtures). If a user purchases a typical linear fluorescent lighting unit, the form factor generally comprises a tube type configuration having a bi-pin electrical connector at each end thereof. Although convenient for use in a commercial ceiling panel lighting fixture or backlit sign, such a fluorescent lighting unit is not well suited for situations where a relatively small lighting unit is needed. For example, even ignoring the difference in electrical connectors, the user would not be able to install the tube type fluorescent lighting unit into a traditional desk lighting fixture, which was designed to accept incandescent bulbs, because the long tube will be too large to fit within the desk lighting fixture. Moreover, the bi-pin electrical connectors of the fluorescent lighting unit and its requirement for a ballast will typically prevent its retrofitting into the desk lighting fixture. As such, the aforementioned lighting units lack versatility.

In the mid to late 1990's the lighting industry experienced the mass introduction of the compact Fluorescent Lamp (CFL) into the marketplace. CFL lighting units provide fluorescent lighting units in a form factor and having electrical connections adapted to be interchangeable with particular incandescent lighting unit form factors. Such CFL lighting units, although providing higher efficiency in a form factor compatible with some incandescent lighting units, suffer from issues associated with both typical incandescent lighting units and typical fluorescent lighting units. For example, the CFL lighting units continue to present an environmental threat, as do other fluorescent lighting units, and are not well suited for situations where light distributed over an area is needed, as with incandescent lighting units. Similar to the situation with a typical incandescent lighting unit, if a user purchases a CFL lighting unit, the user would not be able to connect the CFL lighting unit into a traditional fluorescent lighting fixture because the form factor and electrical connection configuration are wrong for the lighting fixture. As such, while CFL lighting units may bring increased energy efficiency to lighting fixtures adapted to use traditional incandescent lighting units, such CFL lighting units continue to lack versatility. That is, CFL lighting units, as do the other aforementioned lighting units, have a fixed configuration that limit the versatility of the lighting units.

As can be appreciated from the foregoing, various forms of lighting units (e.g., different form factors, different connector configurations, different light emission technology, etc.) must be stocked by or otherwise accessible to lighting system distributors, contractors, workers, and users for use in installing and/or maintaining present day lighting systems. For example, a lighting system distributor may need to stock a plurality of incandescent lighting unit configurations, including various form factors (e.g., different globe shapes and sizes) having various electrical connectors (e.g., different base and conductor configurations) using various technologies (e.g., different filament materials). The lighting system distributor may further need to stock a plurality of fluorescent lighting unit configurations, including various form factors (e.g., different globe shapes and sizes) having various electrical connectors (e.g., different base and conductor configurations) using various technologies (e.g., different cathode configurations). The number of different forms of lighting units such a lighting system distributor would need to purchase, manage, and support can thus become quite large and difficult to adequately control. Such difficulties to a greater or lesser extent are similarly experienced by all persons and entities dealing with lighting systems.

A recent development in the lighting system industry has been the introduction of light emitting diode (LED) lighting units capable of producing white light. While lighting systems implementing LED lighting units are a step toward more efficiency as compared to traditional lighting systems, such LED lighting unit lighting systems have heretofore lacked versatility. The circuit boards, which enable the use of the LEDs, are traditionally hardwired to power supplies and to each other. Many circuit boards are designed in such a way that one circuit board cannot be connected to another circuit board without costly and time consuming wiring. As such, once a lighting system comprising LED lighting units is wired together, the lighting system cannot be easily reconfigured much less repaired. Moreover, even if one circuit board is compatible for connection to another circuit board, the orientation and position of each required connection limits the manner in which the circuit boards can be connected and configured. For example, U.S. Pat. No. 7,591,649 discloses a circuit board with only four permanently set and unmovable connection points. As such, the design of the circuit board restricts the configuration options of the lighting system, thereby limiting the versatility of the lighting systems. Furthermore, lighting systems employing LED lighting units are difficult if not impossible to replace when one or more LEDs fail, and usually the entire lighting fixture needs replacement when a mere component of the lighting system fails.

BRIEF SUMMARY OF THE INVENTION

The present invention is directed to systems and methods which provide a versatile lighting module which may be utilized alone or in combination with other lighting modules to provide any number of lighting unit configurations. Lighting modules of embodiments herein are adapted to facilitate electrical connection, whether to one or more electrical source and/or to one or more other lighting module, along any portion of the entire periphery of the lighting module. Accordingly, lighting modules may be coupled together in any orientation, geometry, and topology to cooperate as a lighting unit (which can comprise a single lighting module, a plurality of lighting modules connected together, a lighting tile, and/or a lighting tile that is connected to one or more additional lighting tiles or lighting modules) having various desired characteristics according to embodiments of the invention.

Lighting modules of embodiments herein may comprise various light sources such as LEDs, fluorescent lamps, neon lamps, any future light source suitable for inclusion in a light module in accordance with the concepts herein, or the like. However, preferred embodiments of the invention comprise one or more LED light sources (e.g., individual LED light sources, LED array light sources, etc.) to provide efficient and long lasting sources of light. A lighting module of embodiments of the invention may, for example, comprise a plurality of individual LED light sources cooperative to provide a lighting module illumination source. Such individual LED light sources are preferably adapted to provide some level of redundancy (e.g., employing a parallel wiring configuration) to facilitate continued operation of the lighting module despite the failure of one or more of the individual LED light sources.

Individual lighting modules are preferably designed such that they are electrically connectable along any portion of the entire periphery of the lighting module. For example, lighting modules of embodiments comprise a conductor bus configuration adapted to facilitate electrical connection along any portion of the periphery of the lighting module. Using corresponding conductor bus connectors, which are preferably provided in a plurality of configurations (e.g., butt connector, angle connectors of differing angles, flexible connectors, extension connectors, etc.) and which may be coupled to lighting modules in any orientation, geometry, and topology, lighting modules of embodiments of the invention may be configured to cooperate as a lighting unit having various desired characteristics (e.g. different sizes, different shapes, different light output, etc.). Thus, the lighting modules of embodiments can be connected to one another at any orientation and/or angle and thereby be made into any desired shape or design of lighting unit. As such, the user can mix and match various lighting modules at varies angles to create shapes that are compatible with any lighting fixture, for example: desk lighting fixtures, ceiling lighting fixtures, sports stadium lighting fixtures, flashlight lighting fixtures, advertising lighting fixtures (e.g. open signs), car lighting fixtures (e.g. head lights, tail lights, dome lights, etc.), security lighting fixtures, appliance lighting fixtures, and the like.

In embodiments of the invention, a lighting tile is provided which comprises an array of the foregoing lighting modules. A lighting tile of embodiments may, for example, comprise a circuit board separated into a plurality of lighting modules, each of which is coupled to its neighboring lighting modules by one or more conductor tabs of the circuit board. Lighting tiles of embodiments herein may be operated as a lighting unit whereby the array of lighting modules are cooperative to provide the lighting tile lighting unit. For example, leveraging the conductor bus of the lighting modules and the conductor tabs of the lighting tile, each such lighting module of the lighting tile may be made to illuminate when power is applied to any portion of the lighting tile (e.g., when power is applied to any of the lighting modules of the lighting tile, all the lighting modules of the lighting tile illuminate). Furthermore, because lighting tiles of embodiments herein comprise lighting modules having the aforementioned conductor bus configuration which is adapted to facilitate electrical connection along any portion of the entire periphery of the lighting module, lighting tiles may be electrically connected to one or more electrical source, to one or more other lighting tile, and/or to one or more lighting module along any portion of the entire periphery of the lighting tile. Using corresponding conductor bus connectors, lighting tiles and/or lighting modules (collectively referred to herein as lighting units) of embodiments of the invention may be configured to cooperate as a lighting unit having various desired characteristics.

Because each respective lighting module of a lighting tile of embodiments herein is individually and fully operational to provide illumination when coupled to a power supply, lighting modules may be separated from a lighting tile (e.g., a user can snap apart one or more select lighting modules to sever their conductor tabs) and use the separated lighting modules as individual lighting units. These separated lighting modules may be coupled to one or more power supplies and/or one or more lighting unit to provide desired lighting unit configurations. Moreover, after one or more other lighting modules have been separated from a lighting tile, the remaining lighting modules, which remain coupled via conductor tabs of embodiments, still illuminate when connected to a power supply and thus remain a lighting tile, albeit a lighting tile of an altered configuration. As such, a user is enabled to create a nearly unlimited number of different lighting unit configurations from one or more lighting tile of a single configuration.

It should be appreciated that the versatility of lighting units of embodiments herein facilitate their use with respect to various lighting systems, applications, and environments. For example, two or more lighting units can be connected together to create a lighting unit sized to fit a particular application or fixture, to provide a desired level of light output, etc. Additionally or alternatively, two or more lighting units can be connected together to create a lighting unit of any desired shape, such as to fit a particular lighting fixture, to provide a desired geometric shape, to provide a desired alphanumeric character, etc.

As an example of the versatility of lighting units of embodiments of the invention, a user can take one or more lighting tiles and connect the lighting tiles and/or lighting modules separated therefrom to form a lighting unit which is the appropriate size and shape to be compatible with any lighting fixture desired. For example, a user can separate lighting modules from a lighting tile and connect the lighting modules together in the appropriate size and shape to be compatible with a ceiling lighting fixture. Likewise, using the same one or more lighting tiles, the user can alternatively connect the lighting tiles and/or lighting modules separated therefrom to form a lighting unit that is the appropriate size and shape to be compatible with a desk lighting fixture. Moreover, because the individual lighting units can be mixed and matched together, if a particular portion of a lighting unit comprised of lighting units fails, the user can replace that single defective lighting unit rather than having to replace the entire lighting unit and/or the entire lighting fixture. Accordingly, persons working with various lighting systems, such as lighting system distributors, contractors, workers, and users, may maintain a stock of lighting tiles and/or lighting modules and be enabled to maintain a large number of lighting system configurations.

Further still, lighting units comprised of the foregoing lighting modules and/or lighting tiles can be made in configurations to be retrofitted to be received and powered by any lighting fixture. For example, a lighting unit may be electrically connected to a power supply that is easily retrofitted into the receptacle of a traditional desk lighting fixture which was designed to receive an incandescent lighting unit. In another example, a lighting unit can be connected to a power supply that is easily retrofitted into the receptacle of a ceiling lighting fixture that was designed to receive a tube type fluorescent lighting unit. Moreover, any lighting fixture can be retrofitted with a retrofit kit to receive lighting units herein. For example, the ballast of a fluorescent lighting fixture can be removed and replaced with a power supply that receives and provides power to a lighting unit of embodiments of the invention.

As such, embodiments of the invention can have low electrical consumption, can produce high lumen output, is long lasting, and is highly versatile. The foregoing has outlined rather broadly the features and technical advantages of the present invention in order that the detailed description of the invention that follows may be better understood.

Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying FIGURES. It is to be expressly understood, however, that each of the FIGURES is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1A:
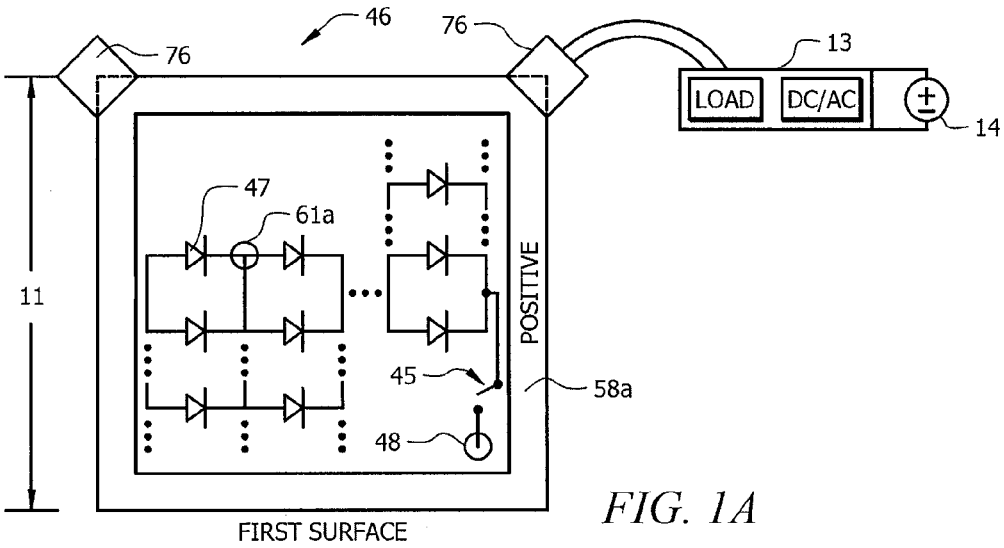
FIGS. 1A-1F show embodiments of lighting modules.
Figure 1B:
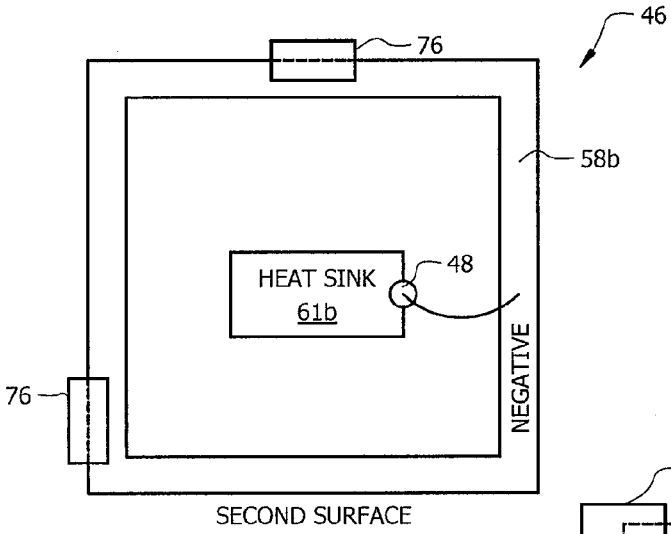
Figure 1C:
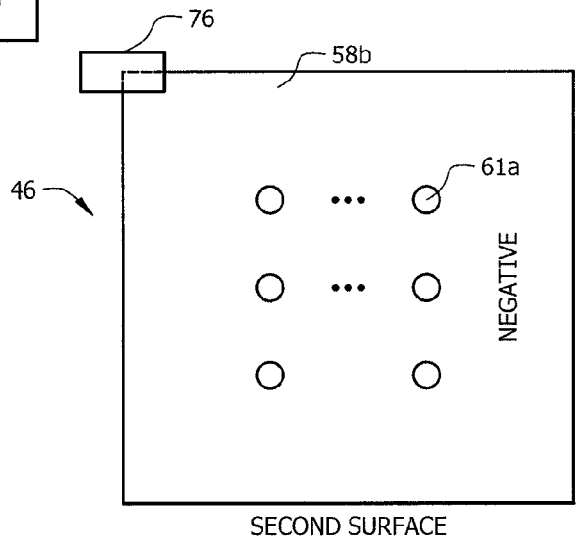
Figure 1D:
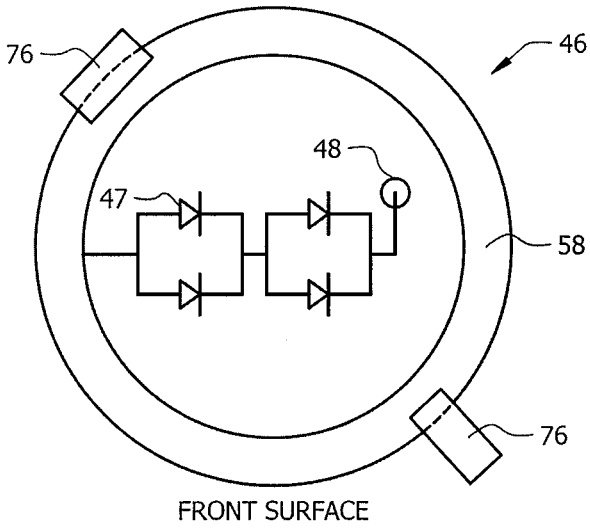
Figure 1E:
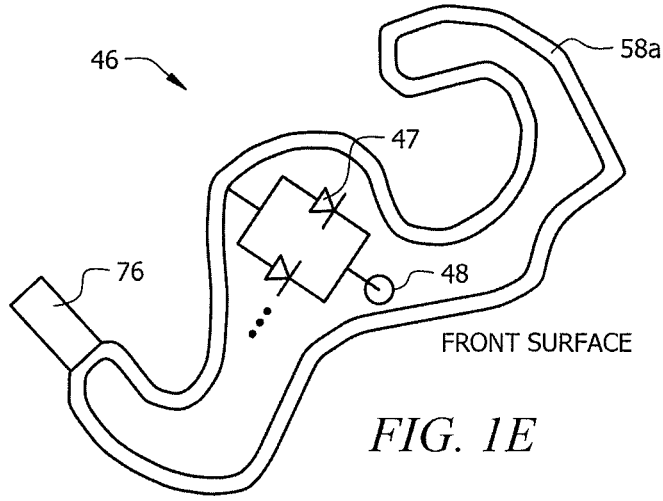
Figure 1F:
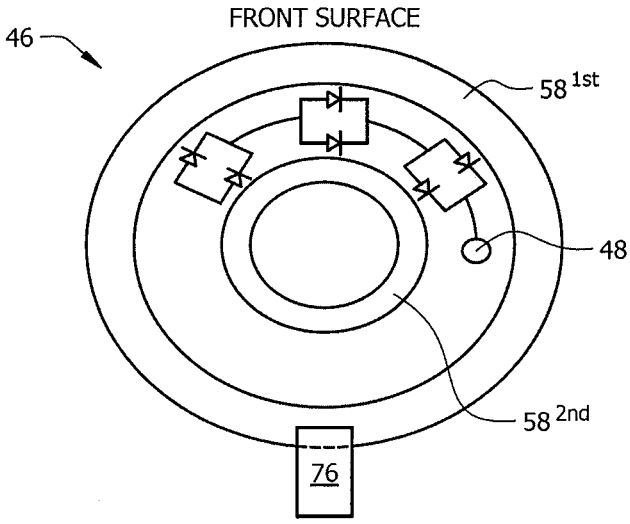

FIGS. 1A-1F show embodiments of the present invention which provide a versatile lighting module 46 which may be utilized alone or in combination with other lighting modules 46. Lighting module 46 comprises a substrate 11. Substrate 11 can be flexible and/or rigid and be made of any material commonly used in the semiconductor industry for example: mylar, polyimide, polyether ether ketone (PEEK), transparent conductive polyester film, fire resistant (e.g. FR-4, FR-6, metal clad) circuit board material, and/or the like. Substrate 11 can be an electrical and/or thermal insulator, and/or the like. Substrate 11 also can be of any color desired including colors that focus light or colors that provide for specular or diffuse reflection. For example, substrate 11 can be white, which may aid in the diffusion of light. Substrate 11 of embodiments can be of any dimension (e.g. height, width, length) and shape (square, rectangular, triangular, symmetrical, asymmetrical, circular, spherical, obtuse, oblong, round, curved, bent, etc.), and may comprise any number of missing segments of any shape in any portion of substrate 11 (e.g. a donut shaped substrate with a hole in the middle). Some shapes and dimensions of substrate 11 can be useful in reflecting or diffusing the illumination of lighting module 46 while other shapes and dimensions of substrate 11 can be useful in focusing light beams. Therefore, the shape and dimension of substrate 11 can be selected to promote light diffusion and/or light focusing. The various shapes can also be designed for aesthetic reasons, lumen output reasons, heat dissipation reasons, power consumption reasons, light diffusion or focusing reasons, connection reasons and/or the like. Examples of various shapes are shown in FIGS. 1A-1F, wherein FIGS. 1A-1C illustrate rectangular shapes; FIG. 1D illustrates a circular shape; FIG. 1E illustrates an asymmetrical shape; and FIG. 1F illustrates a donut shape.

Lighting module 46 comprises one or more light source 47, which may comprise light emission technology such as a light emitting diode (LED) (such as may include: a phosphorus based LED, an organic light-emitting diode (OLED), a quantum dot LED, an LED array), an incandescent light source, a fluorescent light source, a neon light source, and/or the like according to embodiments of the invention. The embodiment illustrated in FIG. 1A shows light source 47 as comprising a plurality of LEDs. Lighting module 46 of embodiments may comprise of a single light source or a plurality of light sources (e.g. a plurality of LEDs or LED arrays). Light sources may be connected in series. Additionally and/or alternatively, light sources may be connected in parallel or series-parallel network configuration; as such, if one or more light source fails, the remaining light sources that are still operable continue to provide illumination. Light source 47 can be positioned at any angle on the board and emit light beams at angle from the board (e.g. emit light straight out, sidewise, at an angle, etc.). The light output from light source 47 can be of any light temperature (e.g. cool or warm hues) and can be of any color including but not limited to white and colors in the visible and non-visible spectrum. A single light source could emit more than one color or could be limited to emit a single color. Individual light sources of a plurality of light sources can all be the same color or can be any combination of various colors. The light emitted from a plurality of light sources can be mixed and/or diffused if desired, wherein the mixed and/or diffused output can be of any color and/or temperature. As such, any number of any color combination of light source 47 can be used to create any temperature and any color in the visible or non-visible spectrum.

Lighting module 46 can also comprise secondary optics, which modify the output of light by one or more lighting source 47. Embodiments can include diverging optics which are commonly utilized for aesthetic reasons (e.g. create ambient light) or collimating optics which is commonly utilized to gather light to meet a photometric specification (e.g. focus a light). In embodiments involving diverging optics, various optical features can be added alone or in combination to lighting module 46 such as a filters, gels, and/or lenses, (e.g. diffuse lenses, faceted lenses, rod lenses, and/or pillow lens), which spread light into a more divergent beam pattern. In embodiments involving collimating optics, various optical features can be added alone or in combination to a lighting module such as filters, shields, reflectors (e.g. reflector cavities, compound parabolic collectors, etc.), and/or Fresnel lenses (e.g. planoconvex lenses, dualconvex lenses, collapsed planoconvex lenses, etc.), which focus the light into a direction. In some embodiments, secondary optics can modify the color output of lighting module for example by using color filters. Moreover, the secondary optics can be modular such that the secondary optic can be attached to or removed from lighting module 46, as is desired.

Lighting emission technology tend to create heat; therefore, heat dissipation of lighting module 46 may be desired. As such, lighting module 46 may comprise one or more heat dissipation component 61 that transfers heat from substrate 11 to another medium (e.g. air). Some example heat dissipation components 61 include but are not limited to thermal via 61*a*, heat sink 61*b*, load resistor (not shown) and/or the like, as shown in FIGS. 1A-1C. A thermal via 61*a* can be included in lighting module by creating a thermal conductive pathway within substrate 11 that conducts heat from a light source and transfers the heat to an area at which it may be dissipated more readily (e.g. heat sink). A heat sink 61*b* can be added to substrate 11 and be made of any appropriate material for dissipating heat, such as aluminum, aluminum alloys, copper, diamond, copper-tungsten, silicon carbide in aluminum matrix (AlSiC), Dymalloy (diamond in copper-silver alloy matrix), E-Material (beryllium oxide in beryllium matrix), and/or the like. A load resistor can be installed to dissipate heat for example, when a power supply exceeds a voltage rating of a lighting module 46. A heat dissipation component 61 can be created at any point on substrate 11 and may be strategically placed below a light source 47 that generate a threshold amount of heat (e.g. at a diode junction). Lighting module 46 can comprise of a single type of heat dissipation components 61 or a variety of types of heat dissipation components 61. Heat dissipation components 61 could be independent of each and/or connected to each other (e.g. a thermal via could connect to a heat sink).

In embodiments, lighting module 46 also comprises conductor bus 58 having conductors 58*a* and conductors 58*b*. Conductor bus 58 connects to light source 47, and when powered, provides power thereto. Lighting module 46 may also comprise a jumper 45, which selectively completes or interrupts the circuit formed from conductor 58*a* through light source 47 to conductor 58*b*. As such, jumper 45 can be used to turn lighting module 46 on and off. For example, if it is desired that lighting module 67 be turned on (e.g. provide illumination), then a user could engage jumper 45, which completes the circuit thereby causing lighting module 46 to light up. Alternatively, if it is desired that lighting module 47 be turned off, then a user could disengage jumper 45, which interrupts the circuit thereby preventing lighting module 46 from lighting up. Of course, jumper 45 can be used for additional other and/or other purposes, such as to optionally add circuitry such as a current limiting resistor.

Conductor bus 58 can also be used to connect lighting module 46 to other devices (e.g. a power supply, other lighting modules, etc). Moreover, conductor bus 58 is adapted to facilitate connection between light module 46 and other devices along any portion of the entire periphery of lighting module 46 and comprises of positive conductor 58*a* and negative conductor 58*b* which provides for the connections. In FIGS. 1A-1C conductor 58*a* is shown as being positive and conductor 58*b* is shown as being negative, but conductor 58*a* could be switched to be a negative and conductor 58*b* could be switched to be a positive, if desired. Conductor bus 58 could be operable to receive an electrical connection. Furthermore, conductor bus 58 could be an input operable to receive information. In embodiments, as shown in FIGS. 1A-1C, conductor 58*a* is on a first surface and conductor 58*b* is on a second surface of lighting module 46. In such embodiments, lighting module 46 can comprise one or more conduction via 48 providing a pathway to conductor 58*b*. Conductor 58*b* may be a strip along the periphery of the exterior of lighting module 46, as shown in FIG. 1B. Alternatively, as shown in FIG. 1C, conductor 58*b* can cover most or all of the second surface wherein conductor 58*b* would operate a connection point and also operate as a heat sink.

Conductor bus 58 is designed such that connection to conductor bus 58 can be made at any point along the entire perimeter of light module 46. In one example, conductors 58*a* and 58*b* are disposed along the entire perimeter of lighting module 46 with no break in the continuity of conductors 58*a* and 58*b*. In alternative embodiments, there may be small breaks in the continuity of conductors 58*a* and 58*b*, including, but not limited to, strategically placed breaks in the continuity of conductors 58*a* and 58*b* at locations which are determined to be unnecessary (e.g. selectively placing breaks at corners, along curves, etc.). In embodiments wherein conductors 58*a* and 58*b* include continuity breaks, conductor bus connectors 76 (described in detail below) allow a conductor bus 58 to receive a connection along any point along the entire periphery of lighting module 46.

Moreover, a lighting module may comprise one or more conductor bus 58. For example, a lighting module may comprise a first conductor bus disposed along the exterior edge of the lighting module and a second conductor bus disposed along an interior portion of the lighting module (e.g. along the periphery of a missing segment of substrate 11). Of course any number of conductor busses could be included in a lighting module. FIG. 1F shows an example of a lighting module 46*f* comprising a first conductor bus $\mathbf{58}^{1st}$ positioned along the exterior of lighting module 46*f* and a second conductor bus $\mathbf{58}^{2nd}$ positioned along a missing segment of the lighting module 46*f* in an interior portion of lighting module 46*f*. As such, in embodiments, a lighting module can receive a connection at any point along the entire periphery of an exterior portion of the lighting module as well as at any point along a missing segment of the lighting module.

Conductor bus connector 76 can be connected to conductor bus 58 in order to connect lighting module 46 to other devices (e.g. a power supply, other lighting modules, a processor, etc.). In embodiments, conductor bus connector 76 comprises at least one input 78 (shown in FIG. 2A) that is operable to receive an edge of lighting module 46 comprising conductor bus 58. Input 78 comprises a positive contact 79*a* on a first surface and a negative contact 79*b* on a second surface. Upon input 78 receiving an edge of lighting module 46, the positive contact 79*a* of input 78 comes into electrical connection with conductor 58*a*, and the negative contact 79*b* of input 78 comes into electrical connection with conductor 58*b* thereby allowing power and/or information to be passed therebetween. The polarity of input 78*a* is shown as being the same as the polarity of a second input 78*b;* however, inputs 78*a* and 78*b* can have opposing polarities, which may allow for a first lighting module 46*a* to be connected facing up while another lighting module 46*b* is connected facing down. The size and shape of input 78 can be operable to create a snug fit over the edge of lighting module 46 securely squeezing the edge of lighting module 46 within and thereby maintaining the connection. This snug fit can be attained with pressure for example by using rigid material, springs, and/or the like.

Conductor bus connector 76 is preferably provided in a plurality of configurations (e.g. butt connector, angle connectors of varying angles, flexible connectors, extension connectors, edge connectors, etc.) and can be removably coupled to the edge of lighting module 46 without the requirement of soldering or hardwiring. Conductor bus connector 76 can be non-permanent, replaceable, disposable, exchangeable, temporary, detachable, slidable, moveable, versatile, and dynamic. Because conductor bus connector 76 is not permanently coupled to conductor bus 58, faulty components can be replaced easily. For example, if lighting module 46 fails, the failed lighting module can be disconnected easily from conductor bus connector 76 and replaced with an operational lighting module 46. Likewise, if conductor bus connector 76 fails, then the failed conductor bus connector 76 can be disconnected and replaced with an operational conductor bus connector 76.

Further, conductor bus 58 can receive a connection at any point along the entire periphery of lighting module 46 and conductor bus connector 76 can connect to conductor bus 58 at any point along the entire periphery of lighting module 46, including but not limited to, the corners of lighting module 46. Moreover, conductor bus connector 76 can move along or slid along any edge of lighting module 46 and all the while maintain its connection to conductor bus 58. As explained above, some embodiments of conductor bus 58 may have breaks in the continuity of conductors 58*a* and/or 58*b*. In such embodiments, contacts 79*a* and 79*b* of input 78 could be large enough contact points such that coupling contacts 79*a* and 79*b* to conductor bus 58 bridges a small break in the continuity, if desired.

Figure 2A:
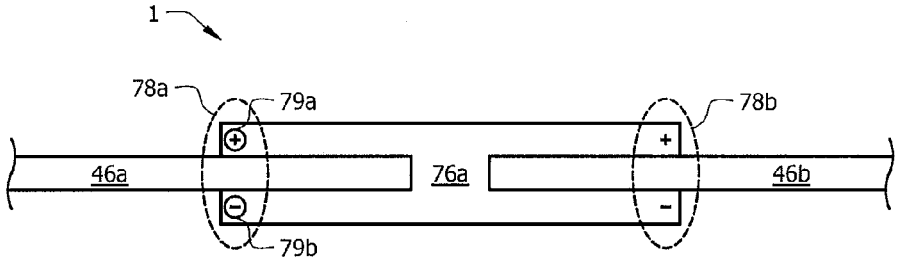
FIGS. 2A-2E show embodiments of conductor bus connectors.
Figure 2B:
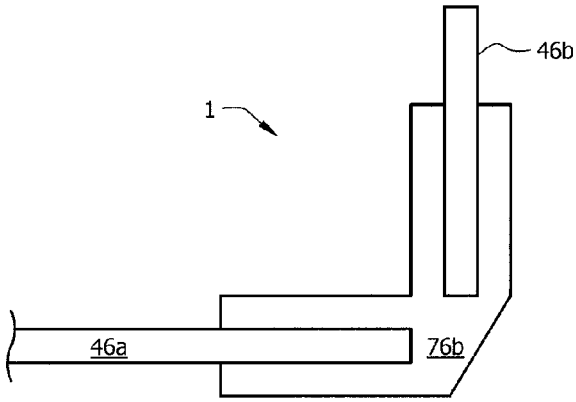
Figure 2C:
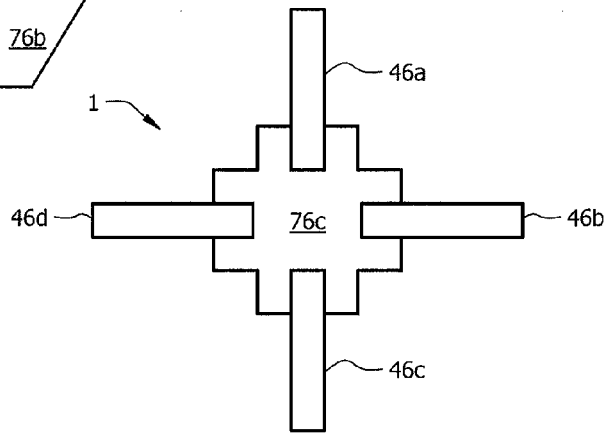
Figure 2D:
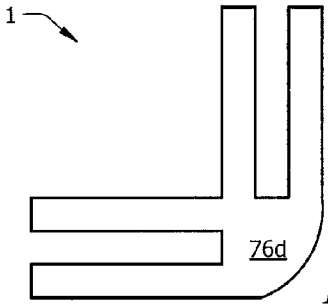
Figure 2E:
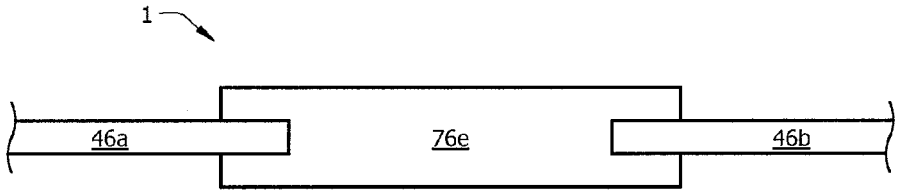

Conductor bus connector 76 can be operable to provide structural support and can be rigid, stiff, firm, malleable, stretchable, flexible, bendable, twistable, elastic, or the like. Moreover, conductor bus connector 76 can be of any orientation, dimension (e.g. height, width, length) and shape (square, rectangular, triangular, symmetrical, asymmetrical, circular, spherical, obtuse, oblong, round, heart-shaped, curved, bent, etc.), and may comprise any number of missing segments (e.g. a donut shape with a hole in the middle). Furthermore, a single conductor bus connector 76 can be operable to connect to any number of conductor buses. FIGS. 2A-2E show various embodiments of conductor bus connectors 76*a*-76*e*. FIG. 2A shows conductor bus connector 76*a* that is rigid; FIG. 2B shows conductor bus connector 76*b* that is oriented at a 90 degree angle, FIG. 2C shows conductor bus connector 76*c* that is configured to connect to up to four lighting modules; FIG. 2D shows conductor bus connector 76*d* that is flexible and/or bendable; and FIG. 2E shows conductor bus connector 76*e* that operates an extender.

Further, conductor bus connector 76 can be made of various materials and provided in various sizes and shapes in order to dissipate heat. For example, conductor bus connector 76 may be made of a selective material, size, and shape so as to operate as a heat sink. Moreover, in embodiments where a threshold distance defines how far apart two devices need to be for a desired level of heat dissipation, the size and/or shape of conductor bus connector 76 may be strategically selected such that devices connected therewith are held at threshold distance from each other.

As stated above, conductor bus connector 76 can operate to connect lighting module 46 to one or more items. An example of a connectable item is power supply 13 as shown in FIG. 1A. Power supply 13 can be any device capable of receiving an input of power, regulating the power as is appropriate, and outputting the regulated power for use in powering a lighting unit. An example of a power supply 13 is an electrical ballast, a halogen lighting fixture power supply, LED driver, or other such similar device. In embodiments, power supply 13 is operable to receive an input from various power sources 14 providing AC and/or DC input (e.g., a car, a generator, a wall outlet/socket, a light switch, any type of battery internal or external to lighting module 46, and/or the like). As such, power supply 13 may comprise an AC/DC converter in order to convert an AC input into a DC output. Power supply 13 can also comprise an electrical load through which the input can be stabilized and regulated such that the output is limited to a level that is appropriate for the particular lighting unit. Some lighting units may require more power than others (e.g. a lighting unit configured for stadium lighting as opposed to a lighting unit configured for a desk lamp). As such, the power output of power supply 13 may vary according to the characteristics of a particular lighting unit and/or lighting fixture. In embodiments, conductor bus connector 76 is operable to connect to one or more power supply 13 serially, in parallel, in any combination thereof. If conductor bus connector 76 is connected to more than one power supply 13 in parallel, then if one of the power supplies 13 fails, the power supplies 13 which remain operable continue to provide power to lighting module 46, thereby providing redundancy.

Figure 3A:
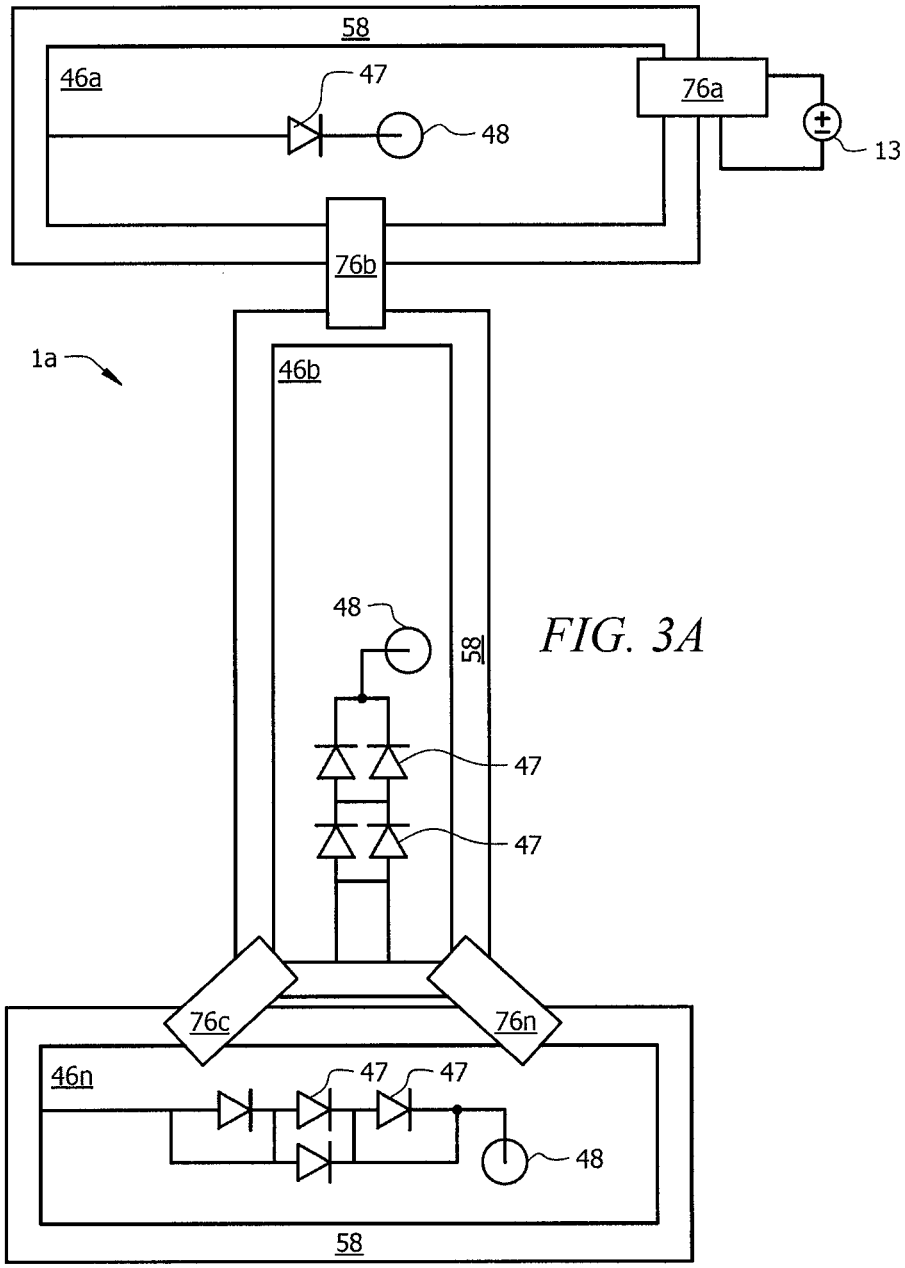
FIGS. 3A-3B show embodiments of the lighting units formed from a plurality of lighting modules.

Another example of an item that conductor bus connector 76 is operable to connect to is another lighting module. An embodiment of lighting unit 1 is shown in FIG. 3A, which comprises a plurality of conductor bus connectors 76*a*-76*n* that operate to connect lighting module 46*a* to one or more other lighting modules 46*b*-46*n*, as shown in FIG. 3A. In this example, lighting module 46*a* is connected to power supply 13 through conductor bus connector 76*a;* as such, lighting module 46*a* receives power from power supply 13. Further, lighting module 46*b* is connected to lighting module 46*a* through conductor bus connector 76*b;* therefore, lighting module 46*b* receives power from power supply 13 through its connection with lighting module 46*a*. Further still, lighting module 46*n* is connected to lighting module 46*b* through conductor bus connectors 76*c*-76*d;* thus, lighting module 46*n* receives power from power supply 13 through its connection with lighting module 46*b*. As such, in this example, each lighting module of lighting unit 20*a* receives power from common power supply 13 through the connections made by each of conductor bus connectors.

In an alternative embodiment, common power supply 13 can be connected to more than one conductor bus connector 76; thus, if one or more of the conductor bus connectors 76 fail, the lighting unit will remain powered as long as at least one of the conductor bus connectors 76 remains operable. Additionally or alternatively, one or more conductor bus connector 76 can be connected to more than one power supply in series, parallel, and/or both. One of the benefits of connecting the power supplies in parallel is redundancy, wherein the light source will remain powered as long as at least one of the power supplies remains operational.

As explained above, conductor bus connector 76 can be operable to provide structural support for power supplies. In the embodiment shown in FIG. 3A, conductor bus connectors 76*a*-76*n* are rigid and provide structural support for lighting unit 20*a* by holding the lighting modules 46*a*-46*n* in the shape of the letter "I." In an alternative embodiment, a lighting unit may comprise one or more conductor bus connector 76 that as/are flexible as well as one or more other conductor bus connector 76 that is/are rigid. Any of the number of conductor bus connector 76 and any various type of conductor bus connector 76 described above can be used in a lighting unit.

Moreover, conductor bus connector 76 can connect lighting modules 46 to each other at any angle or orientation to each other along the X, Y, and/or Z axis. FIG. 3A, illustrates a lighting unit 1*a* wherein lighting module 46*a* is positioned perpendicular to lighting module 46*b* and parallel to lighting module 46*n*. In other embodiments, lighting modules 46 can be positioned at obtuse or acute angles to each other and/or an angle of zero or 180 degrees.

Figure 3B:
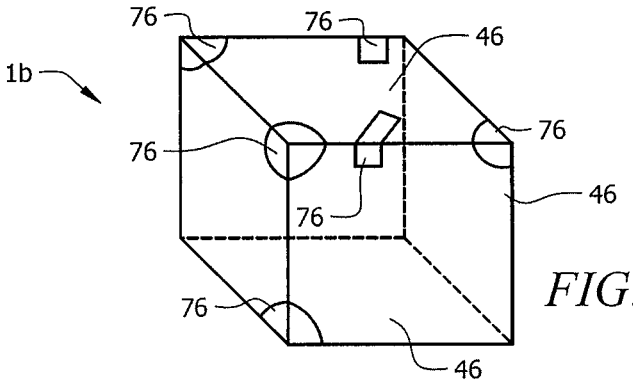

FIG. 3B illustrates a lighting unit 1*b* comprising six lighting modules positioned such that lighting unit 1*b* is in the shape of a cube. In this embodiment, various conductor bus connector 76 of various sizes, shapes, and orientations are used to connect the lighting modules 46. Of course, any number, size, shape, and orientation of conductor bus connector 76 can be mixed and/or matched to connect any number, size, and/or shape of lighting modules into a lighting unit 20 of any size, and/or shape. Further, because some embodiments of lighting modules 46 are disposed on a flexible substrate 11, lighting modules 46 can be flexed and/or bend into various shapes and/or designs. In some embodiments, lighting unit 1 can be formed to create shapes that are compatible with any lighting fixture, for example: desk lighting fixtures, ceiling lighting fixtures, sports stadium lighting fixtures, flashlight lighting fixtures, lighting fixtures (e.g. open signs), car lighting fixtures (e.g. head lights, tail lights, dome lights, etc.), security lighting fixtures, lighting fixtures, and any other such lighting fixtures.

Figure 4:
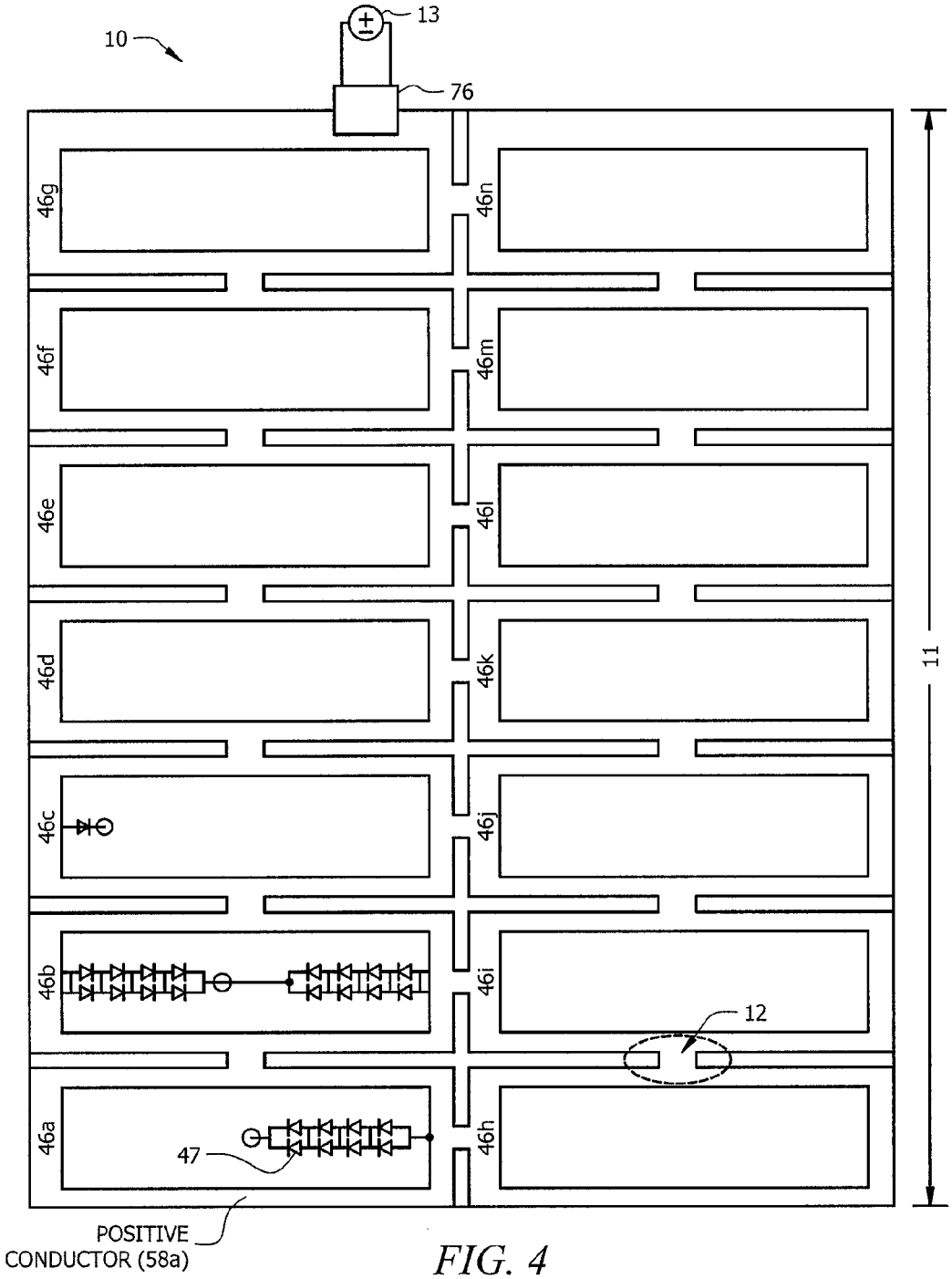
FIG. 4 shows an embodiment of a lighting tile.
Figure 5:
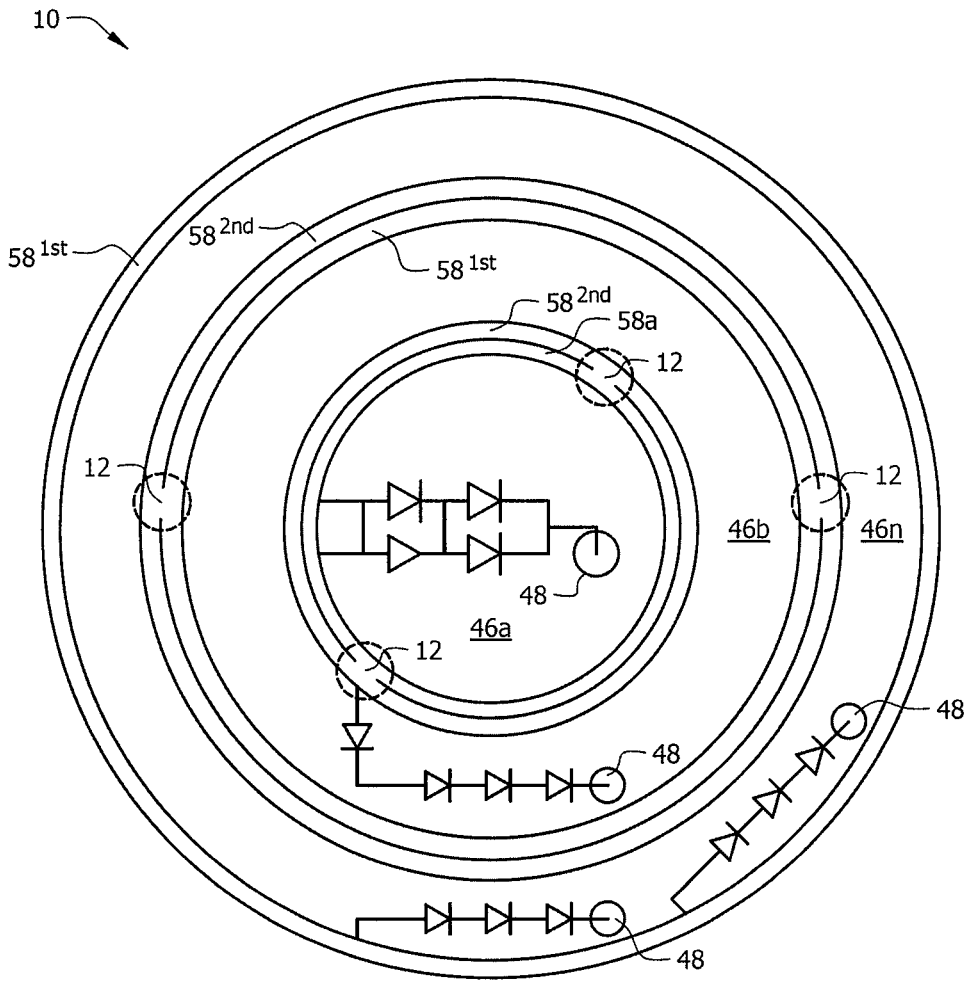
FIG. 5 shows an alternative embodiment of a lighting tile.

An alternative type of lighting unit is a lighting tile 10. Lighting tile 10 is a lighting unit that comprises a plurality of the aforementioned lighting modules 46 which, although manufactured on a single substrate, are adapted to be separated. FIG. 4 illustrates lighting tile 10 comprising an array of rectangular lighting modules 46 connected in the shape of a rectangle. FIG. 5 illustrates lighting tile 10 comprising an array of donut shaped lighting modules 46*b*-46*n* with a circular lighting module 46*a* in its center. In alternative embodiments, lighting tile 10 can be of any shape and may comprise lighting modules 46 of varying shapes.

The lighting modules 46 of lighting tile 10 are designed to removable from lighting tile 10. In embodiments, conductor tabs 12 are formed between the conductor bus 58 of a first lighting module 46*a* to the conductor bus 58 of another lighting module 46*b*, thereby providing a connection there between. Conductor tabs 12 can comprise portions of substrate 11, which have not been removed between the lighting modules to thereby provide physical, structural, and electrical connections between lighting modules 46, provide information transfers between lighting modules 46, and provide structural support to maintain the structure of lighting tile 10. Conductor tabs 12 can be any non-permanent junction, which conducts electricity from one conductor bus 58 to another for example by having perforated edges and/or being configured to be removable by being snappable, breakable, cuttable, tearable, removable, pop-outable, meltable, and/or the like. Conductor tabs 12 can be created during manufacture of lighting tile 10, for example through routing, wherein of portion of the printed circuit board is not cut away from the conductor buses of adjacent lighting modules thereby creating the conductor tab 12.

As explained above, each of lighting modules 46*a*-46*n* have conductor bus 58 which is adapted to facilitate electrical connection along any portion of the entire periphery of a lighting module 46. Thus, lighting tile 10 may be electrically connected to one or more electrical source along any portion of the entire periphery of the lighting tile 10. Conductor bus connector 76 can be used to connect lighting tile 10 to the electrical source. Furthermore, any power connected to any portion along the periphery of lighting tile 10 is distributed among all the lighting modules 46 because the conductor busses 58 of the lighting modules 46 are connected to each other with conductor tabs 12. As such, one or more power supply 13 connection is sufficient to power each and every lighting module 46 of lighting tile 10 regardless of the peripheral location of the power supply 13 connection.

Moreover, lighting tile 10 may be electrically connected to one or more additional lighting tiles and/or lighting modules along any portion of the entire periphery of lighting tile 10 using conductor bus connecter 76. In such a configuration, when lighting tile 10 is powered on, the power will be transmitted through conductor bus connector 76 to the additional lighting tiles. As such, one or more power supply 13 connection is sufficient to power each and every additionally connected lighting tile 10 and/or lighting module.

When lighting tile 10 is connected to power, the individual modules 46*a*-46*n* individually provide illumination, and the combination of the individually lit lighting modules 46*a*-46*n* provide the overall illumination of lighting tile 10. Moreover, because all the conductor bus connectors 58 are interconnected, lighting tile 10 continues to provide overall illumination even when one of the individual lighting modules 46*a*-46*n* no longer provides individual illumination. As such, if for any reason a user decides to change the illumination configuration of lighting tile 10 (e.g. to change the lumen output, the power consumption, and/or the heat generation of lighting tile 10), a jumper of one or more lighting modules 46 can be disengaged thereby turning off the selected one or more lighting module 46 without affecting the operability of the other lighting modules 46. Of course the opposite is possible too, such that a user may selectively enable one or more particular lighting modules 46 by engaging jumper 45 thereby causing the enabled lighting module 46 to illuminate. Each individual lighting module 46 could be enabled and disabled using jumper 45 as desired from time to time such that the user can select a desired lumen output, power consumption, and heat generation for any given circumstance at any given time.

Additionally and/or alternatively, one or more lighting modules 46 can be selectively removed from lighting tile 10 by snapping, breaking, cutting, tearing, or otherwise removing the conductor tabs 12 connecting the selected lighting module to lighting tile 10. As a result, the selected lighting module 46 is physically and electronically separated from lighting tile 10. When a particular lighting module 46 is removed from lighting tile 10, the remaining lighting modules 46, which were not removed from lighting tile 10, are still connected to one another and power supply 13 (if so attached) through the remaining, undisturbed conductor tabs 12 and therefore will continue to operate as a contiguous group.

Moreover, the removed lighting module 46 is still fully operational after being removed from the lighting tile. As such, the removed lighting module 46 can be connected to power supply 13, using conductive bus connector 76, and thereafter provide illumination. In embodiments, a plurality of lighting modules can be removed from one or more lighting tile and connected together with conductor bus connector 76 to create a new lighting unit.

The above described are features of lighting tile 10 and lighting modules 46 that can be utilized to create lighting units of various sizes, shapes, and designs. For example, lighting tile 10 can be configured to display a desired output (e.g. a select shape, design, or character such as a star, a smiley face, numbers, letters, etc.) by selecting the appropriate lighting modules 46 to be enabled and select the appropriate lighting modules 46 to be disabled such that lighting tile 10 displays the desired shape, design, character, or the like. Additionally and/or alternatively, select lighting modules could be removed from lighting tile 10 to display the desired output. If a single lighting tile 10 is not large enough to display the desired output, the user could connect one or more additional lighting tiles and/or lighting modules, and enable, disable, and/or remove select lighting modules to display the desired output. Alternatively, a plurality of lighting modules can be connected together at various angles and orientations to display the desired output (e.g. to spell out a word). Such an embodiment would be useful in advertising displays such as WELCOME signs and OPEN signs.

The above described features of lighting tile 10 and lighting modules 46 can be utilized to create large lighting units with large lumen output. For example, numerous lighting tiles and/or lighting modules can be connected together using conductor bus connector 76 to create a lighting unit of any desired size and/or lumen output. Such an embodiment would be useful in providing large amounts of light and could be used for flood lighting, retail store lighting, warehouse lighting, stadium lighting, airport runway lighting, and/or the like.

The aforementioned features of lighting tile 10 and lighting modules 46 could be used to create a lighting unit of the proper size and shape to fit within legacy indoor lighting systems (e.g. desk lamps, ceiling panel light fixtures, etc.) For example, the user could use lighting tile 10 and remove select lighting modules from lighting tile 10 to create a lighting unit in the correct size and/or shape of a traditional incandescent light bulb. Alternatively, a user could connect a plurality of lighting modules using conductor bus connectors 76 into the size and/or shape of a traditional incandescent light bulb. Because the lighting modules and light tiles can be printed on a flexible substrate and connected at any angle and/or orientation to each other, a lighting unit can be created in almost any shape, design, and/or configuration, and as such, the lighting unit created could closely resemble an incandescent light bulb and/or fluorescent tube lamp. Examples of lighting modules being connected together with conductor bus connectors 76 to create a lighting unit of a shape and design that fits in a desk lamp are shown in FIG. 6A.

Figure 6A:
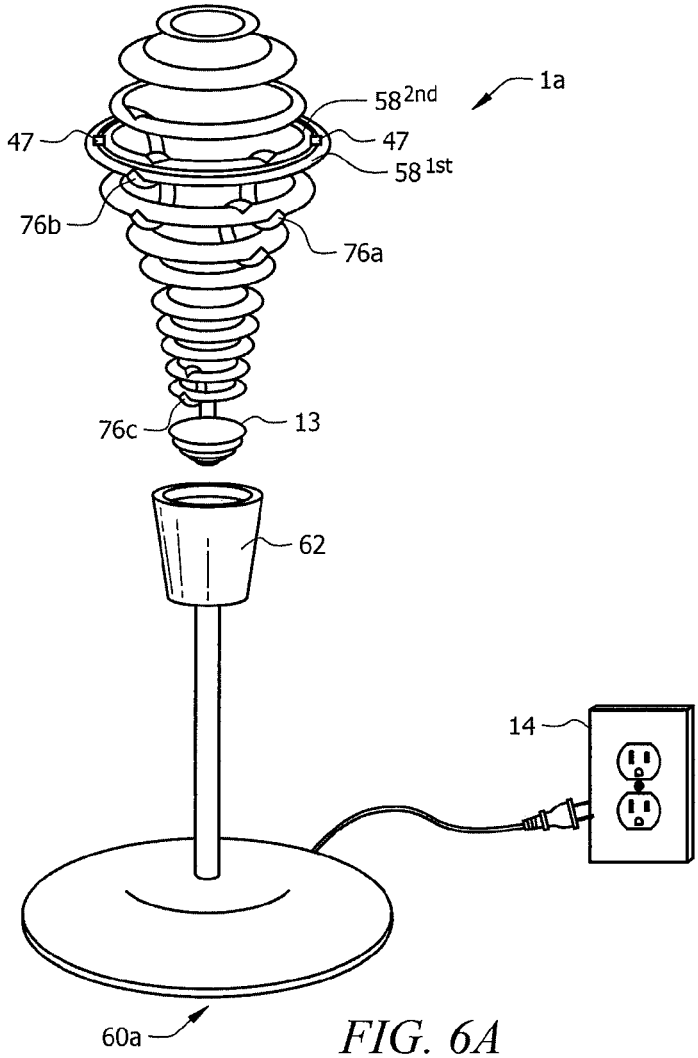
FIGS. 6A-6D shows embodiments of lighting fixtures receiving various lighting units.

In FIG. 6A, lighting unit 1*a* comprise of several donut shaped lighting modules 46*a*-46*n* that were selectively removed from a lighting tile (e.g. a lighting tile similar to the one illustrated in FIG. 5B). The lighting modules in this example have conductor bus 58 disposed on the inner periphery of each lighting module. "U" shaped conductor bus connectors 76 are used to provide connections between the conductor bus 58 of one lighting module and another and connection to power supply 13. In this embodiment the "U" shaped conductor bus connectors also provide structural support to the lighting unit by helping maintain the shape of the lighting unit.

Figure 6B:
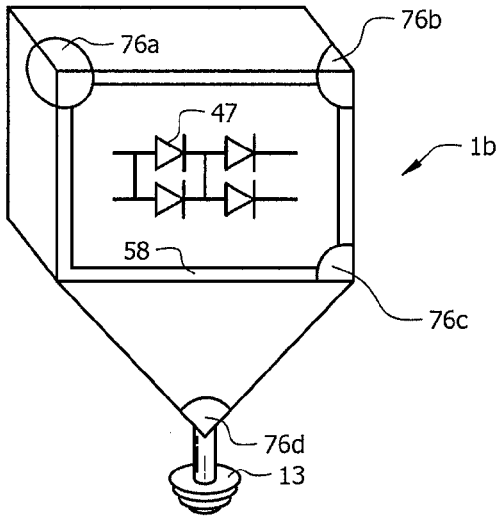

FIG. 6B also shows lighting unit 1*b* which is an alternative embodiment comprising lighting modules that are connected together with conductor bus connector 76 to create a lighting unit of a shape and design that fits in a desk lamp. In this embodiment nine lighting modules 46*a*-46*n* are connected together with various conductor bus connector 76*a*-76*n*. The top portion of lighting unit 1*b* comprises of five square shaped lighting modules forming an open bottomed cube. The bottom portion of lighting unit 1*b* comprises of four triangular shaped lighting modules forming an upside down pyramid with an opening. The top and bottom portion of lighting unit 1*b* are connected together to form a lighting unit resembling an incandescent light bulb. In this embodiment, conductor bus connectors 76*a* and 76*b* are circular in shape and configured to connect at least three lighting modules positioned at 90 degree angles from each other; conductor bus connector 76*c* is circular in shape and configured to connect at least four lighting modules positioned at varying angles to each other; and conductor bus connector 76*d* is in a circular shape and configured to connect at least four lighting modules and power supply 13 at varying angles.

Figure 6C:
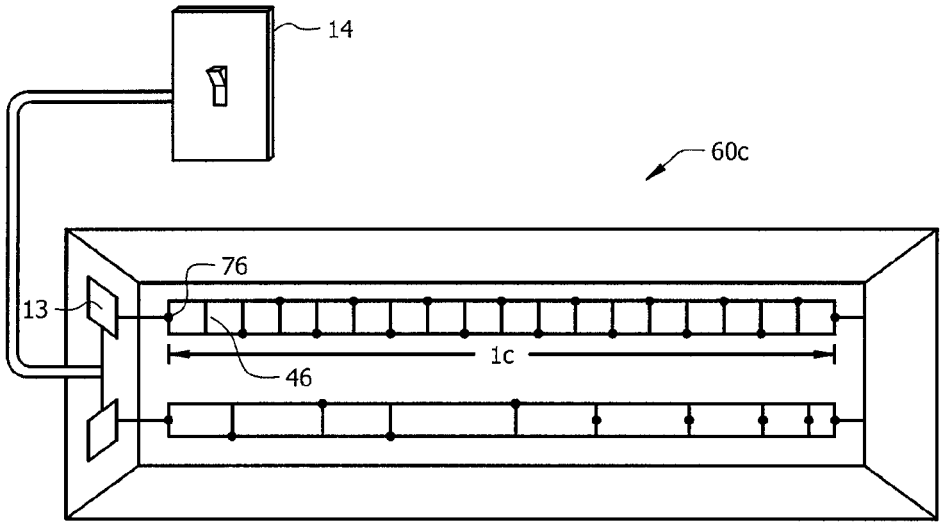

FIG. 6C shows lighting unit 1*c* which is an alternative embodiment of lighting modules being connected together with conductor bus connectors 76 to create a lighting unit 1*c* of a shape and design that fits into a ceiling panel light fixture. In this embodiment, several lighting modules 46 are connected together with a plurality of conductor bus connectors 76 in the same length and width of a fluorescent tube lamp of the appropriate size to fit within the ceiling panel light fixture. At least one of the conductor bus connector 76 connects to power source 13. In this embodiment, conductor bus connector 76 are rigid and provide the structural support to maintain the shape of lighting unit 1*c*. In an alternative embodiment, the lighting modules are affixed to a rigid support (e.g. a rod of the appropriate dimensions) and the conductor bus connector 76 can be flexible or rigid as may be desired. In another embodiment, the substrates of the lighting modules are flexible and the conductor bus connectors are flexible, and the lighting unit 1*c* is wrapped around a rigid support (e.g. a pole of the appropriate dimensions).

Figure 6D:
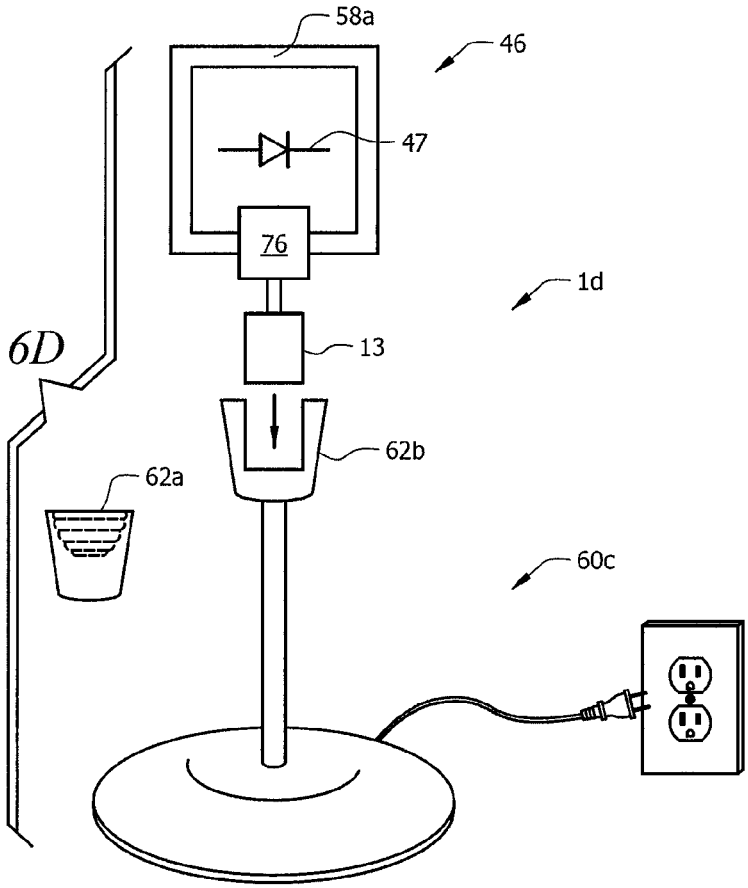

As such, lighting units are highly versatile because lighting units can be configured in any shape or design of any size or topology and be made to output any number of lumens using one or more of the lighting tiles 10, lighting modules 46, and conductor bus connectors 76. It should be appreciated that the versatility of lighting units of embodiments herein facilitate their use with respect to various lighting systems, applications, and environments. Moreover, power supply 13 can be configured to be adaptable to various lighting systems, applications, and environments. For example, power supply 13 could be specifically designed to provide power from a particular lighting fixture to a particular lighting unit. Alternatively, power supply 13 could be configured to provide power to various lighting units from any light fixture whatsoever, for example a traditional desk lamp, a ceiling panel light fixture, a stadium lighting fixture, an appliance lighting fixture, a car headlamp lighting fixture, a neon sign lighting fixture, a high bay warehouse lighting fixture, and/or the like. FIGS. 6A, 6C, and 6D illustrate systems and methods wherein power supply 13 provides power to lighting units from legacy lighting fixtures 60.

FIG. 6A illustrates a desk lamp lighting fixture 60*a*, which was originally designed to provide power to an incandescent light source (e.g. incandescent light bulb) or a CF lamp. In this illustrated embodiment, lighting unit 1*a* is retrofitted to be compatible with lighting fixture 60*a*. According to the embodiment, conductor bus connector 76*c* connects to one of the lighting modules and also connects to power supply 13. Power supply 13 is shaped to mimic a legacy connection that screws-into receptacle 62 and is operable to be received by receptacle 63 of lighting fixture 60*a* (e.g. by screwing power supply 63 into receptacle 63). Once power supply 13 is electrically coupled to lighting fixture 60*a* through receptacle 63, power supply 13 can receive an input of power from power source 14, in this case the wall outlet.

In an alternative embodiment, shown in FIG. 6D, a receptacle of a legacy lighting fixture can be retrofitted to receive a power supply which is shaped in a manner that is not compatible with the original design of the legacy lighting fixture. In this embodiment, power supply 13 is in the shape of a cube and designed to slide into a cube shaped receptacle. As such, legacy receptacle 62*a* (which was not originally designed to receive a cube shape) is removed from lighting fixture 60 and replaced with a retrofitted receptacle 62*b* operable to connect to a cube shaped power supply 13. Power supply 13 is operable to connect to any conductor bus connector 76 which is connectable to light module 46. If desired, because conductor bus connector 76 is connectable to any various light module, a user could swap various lighting units in and out of connection with conductor bus connector 76. As such, after retrofitting, lighting fixture 60*d* is operable to connect to any number of various lighting units.

Another example is shown in FIG. 6C, wherein legacy lighting fixture 60*c* is retrofitted to accept lighting unit 1*c*. In this example, the legacy lighting fixture is a ceiling panel lighting fixture originally designed to accept linear fluorescent tube lamps having a bi-prong connection. In order the retrofit light fixture 60*c*, the user removes the ballast that was originally provided with lighting fixture 60*c* and replaces the ballast with power supply 13. With power supply 13 in place, conductor bus connector 76 can be connected to power supply 13 and to at least one lighting module 46, thereby providing power to lighting unit 1*c*. In this example, when power source 14 (the light switch in this example) is switched on, power supply 13 will receive an input of power which will be regulated and output to conductor bus connector 76 which will provide power to lighting module 46 which will in turn provide power to all the lighting modules of lighting unit 1*c*.

As such, embodiments of the present invention are directed to systems and methods which provide a versatile lighting module which may be utilized alone or in combination with other lighting modules to provide any number of lighting unit configurations. Moreover, lighting units are adaptable to receive power from any number of lighting fixtures including legacy lighting fixtures.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A lighting tile for providing configurable lighting elements, the lighting tile comprising:

a substrate member;

a plurality of lighting modules, wherein each lighting module of the plurality of lighting modules is provided upon the substrate member and the plurality of lighting modules are electrically connected and collectively operable as a single lighting element, wherein each lighting module comprises:

at least a light emitting diode; and a conductor bus disposed along the periphery of the lighting module; and a plurality of conductor tabs formed from portions of the substrate member and disposed throughout the lighting tile structurally connecting adjacent lighting modules of the lighting tile and electrically connecting the conductor buses of the lighting modules of the lighting tile, wherein the plurality of conductor tabs are adapted to facilitate separation of lighting modules of the plurality of lighting modules to provide individually operable lighting elements, wherein lighting modules of the plurality of lighting modules are operable as individual lighting elements when separated from other lighting modules of the lighting tile while the lighting modules remaining connected as the lighting tile continue to be collectively operable as a single lighting element.

2. The lighting tile of claim 1, wherein the substrate member comprises a portion of printed circuit board material in a predetermined shape defining the lighting tile and the plurality of lighting modules.

3. The lighting tile of claim 2, wherein the plurality of conductor tabs comprise portions of the printed circuit board material bridging a gap between adjacent lighting modules of the plurality of lighting modules and are adapted to enable breaking of the bridging portions of the printed circuit board material to facilitate separation of selected lighting modules of the lighting tile.

4. The lighting tile of claim 3 wherein a conductor tab of the plurality of conductor tabs connecting adjacent lighting modules comprises a perforated portion of the printed circuit board material bridging the gap between the adjacent lighting modules.

5. A lighting unit comprising:

a plurality of lighting modules, wherein each lighting module of the plurality of lighting modules is provided upon a substrate material and are adapted to be collectively operable as a lighting element when interconnected to other lighting modules and to be individually operable as lighting elements when separated from other lighting modules, wherein each lighting module comprises:

at least a light emitting diode; and a conductor bus disposed along the periphery of the lighting module; and a plurality of conductor tabs formed from the substrate material and disposed along the periphery of lighting modules of the plurality of lighting modules, wherein the plurality of conductor tabs are adapted to facilitate separation of lighting modules of the plurality of lighting modules by breaking a portion of the substrate material forming one or more conductor tab, and wherein conductor tabs of the plurality of conductor tabs provide structural and electrical connection of adjacent lighting modules of the plurality of lighting modules prior to separation of the adjacent lighting modules.

6. The lighting unit of claim 5, wherein the substrate material comprises a printed circuit board member in a predetermined shape defining a lighting tile having two or more lighting modules of the plurality of lighting modules structurally and electrically connected by one or more conductor tabs of the plurality of connector tabs.

7. The lighting unit of claim 6, wherein the one or more conductor tabs comprise portions of the printed circuit board material bridging a gap between adjacent lighting modules of the two or more lighting modules and are adapted to enable breaking of the bridging portions of the printed circuit board material to facilitate separation of selected lighting modules of the lighting tile.

8. The lighting tile of claim 7 wherein a conductor tab of the one or more conductor tabs connecting adjacent lighting modules comprises a perforated portion of the printed circuit board material bridging the gap between the adjacent lighting modules.

9. The lighting unit of claim 6, further comprising a lighting module separated from the lighting tile and electrically connected to the lighting tile using at least one conductor bus connector to provide a selected lighting element including the lighting tile and the lighting module.

10. The lighting unit of claim 5, further comprising:

a plurality of conductor bus connectors adapted to interconnect a plurality of lighting modules in a plurality of selectable configurations to define a selected lighting element configuration, wherein each conductor bus connector of the plurality of conductor bus connectors provides electrical connection of the conductor buses of at least two adjacent lighting modules of the selected lighting element.

11. The lighting unit of claim 5, further comprising:

a first lighting module of the plurality of lighting modules; and a second lighting module of the plurality of lighting modules, wherein the first lighting module has a first shape and the second lighting module has a second shape, the first shape and the second shape being different.

12. The lighting unit of claim 5, further comprising:

a conductor bus connector providing an electrical connection to at least one conductor bus of the plurality of lighting modules at any point along the periphery of the lighting unit, and wherein the electrical connection transfers power to the lighting unit.

13. The lighting unit of claim 11 further comprising:

a power supply, wherein the power supply is connected to the conductor bus connector, and wherein the power supply is shaped to be received by a legacy receptacle of a legacy lighting fixture.

14. The lighting unit of claim 12 wherein the legacy lighting fixture is at least one of:

a desk lamp operable to receive an incandescent light bulb;

a high bay warehouse fixture;

a retail fixture; and a ceiling panel operable to receive a fluorescent tube lamp.

15. A method of forming a lighting unit comprising:

obtaining a lighting tile comprising:

a substrate member;

a plurality of lighting modules, wherein each lighting module of the plurality of lighting modules is provided upon the substrate member and the plurality of lighting modules are electrically connected and collectively operable as a single lighting element, wherein each lighting module comprises at least a light emitting diode and a conductor bus disposed along the periphery of the lighting module; and a plurality of conductor tabs formed from portions of the substrate member structurally connecting adjacent lighting modules of the lighting tile and electrically connecting the conductor buses of the lighting modules of the lighting tile, wherein the plurality of conductor tabs are adapted to facilitate separation of lighting modules of the plurality of lighting modules to provide individually operable lighting elements, wherein lighting modules of the plurality of lighting modules are operable as individual lighting elements when separated from other lighting modules of the lighting tile while the lighting modules remaining connected as the lighting tile continue to be collectively operable as a single lighting element; and separating at least one lighting module of the plurality of lighting modules from the lighting tile by breaking of a conductor tab structurally connecting the at least one lighting module to at least one adjacent lighting module of the lighting tile.

16. The method of claim 15 further comprising:

coupling the separated at least one lighting module to the lighting tile using at least one conductor bus connector to provide a selected lighting element including the lighting tile and the separated at least one lighting module.

17. The method of claim 15 wherein separating the at least one lighting module comprises:

separating a first lighting module of the plurality of lighting modules from the lighting tile;

separating a second lighting module of the plurality of lighting modules from the lighting tile; and coupling the first lighting module to the second lighting module using at least one conductor bus connector to provide a selected lighting element including the first lighting module and the second lighting module.

18. The method of claim 17 wherein the first lighting module has a first shape and the second lighting module has a second shape, the first shape and the second shape being different.

19. The method of claim 17 further comprising:

a first conductor bus connector coupling the first lighting module to a power supply, the power supply providing power to the first lighting module; and a second conductor bus connector coupling the first lighting module to the second lighting module, wherein the second bus connector is operable to transfer the power from the first lighting module to the second lighting module.

20. The method of claim 17 further comprising:

coupling the at least one conductor bus connector to a power supply, wherein the power supply is shaped to be received by a legacy receptacle of a legacy lighting fixture.

21. The method of claim 20 wherein the legacy lighting fixture is at least one of:

a desk lamp operable to receive an incandescent light bulb;

a high bay warehouse fixture;

a retail fixture; and a ceiling panel operable to receive a fluorescent tube lamp.

22. The method of claim 17 further comprising:

coupling the at least one conductor bus connector to a power supply, wherein the power supply is shaped to be received by a legacy receptacle of a legacy lighting fixture.

23. The method of claim 22 wherein the legacy lighting fixture is at least one of:

a desk lamp operable to receive an incandescent light bulb;

a high bay warehouse fixture;

a retail fixture; and a ceiling panel operable to receive a fluorescent tube lamp.

* * * * *

UNITED STATES PATENT AND TRADEMARK OFFICE

CERTIFICATE OF CORRECTION

PATENT NO. : 8,764,236 B2
APPLICATION NO. : 13/557582
DATED : July 1, 2014
INVENTOR(S) : Caroom, Jr. et al.

It is certified that error appears in the above-identified patent and that said Letters Patent is hereby corrected as shown below:

In the Specification

Column 1, line 48, delete "globe type convenient" and replace with --globe type configuration often having a screw type electrical connector at the base thereof. Although--.

Signed and Sealed this
Second Day of September, 2014

Michelle K. Lee

Michelle K. Lee
*Deputy Director of the United States Patent and Trademark Office*